US005522370A

United States Patent [19]

Katoh et al.

[11] Patent Number: 5,522,370

[45] Date of Patent: Jun. 4, 1996

[54] MULTI-CYLINDER ENGINE CONTROL SYSTEM

[75] Inventors: Masahiko Katoh; Kimihiro Nonaka; Kazuhiro Nakamura, all of Hamamatsu, Japan

[73] Assignee: Sanshin Kogyo Kabushiki Kaisha, Hamamatsu, Japan

[21] Appl. No.: 484,966

[22] Filed: Jun. 7, 1995

[30] Foreign Application Priority Data

Jun. 24, 1994 [JP] Japan ..... 6-143667

[51] Int. Cl.[6] ..... F02D 41/14; F01M 1/16

[52] U.S. Cl. ..... 123/685; 123/73 AD; 123/481; 123/491; 123/703

[58] Field of Search ..... 123/73 AD, 196 R, 123/196 W, 481, 491, 679, 685, 703; 60/276

[56] References Cited

U.S. PATENT DOCUMENTS

| | | | |
|---|---|---|---|
| 4,768,474 | 9/1988 | Fujimoto et al. | 123/481 |
| 4,831,820 | 5/1989 | Lassankse | 60/276 |
| 4,903,648 | 2/1990 | Lassankse | 123/703 |
| 4,967,700 | 11/1990 | Torigai | 123/73 AD |
| 4,991,558 | 2/1991 | Daly et al. | 123/481 |
| 5,038,739 | 8/1991 | Ishii | 123/481 |
| 5,040,117 | 8/1991 | Shyu et al. | 123/703 |
| 5,097,811 | 3/1992 | Baumuller | 123/481 |
| 5,283,742 | 2/1994 | Wazaki et al. | 123/481 |
| 5,287,279 | 2/1994 | Anan | 123/481 |
| 5,311,854 | 5/1994 | Cullum | 123/703 |
| 5,315,971 | 5/1994 | Yamada | 123/73 AD |
| 5,322,044 | 6/1994 | Maebashi | 123/491 |
| 5,370,089 | 12/1994 | Harada | 123/73 AD |
| 5,390,635 | 2/1995 | Kidera et al. | 123/73 AD |
| 5,404,857 | 4/1995 | Schommers | 123/481 |
| 5,441,030 | 8/1995 | Satsukawa | 123/491 |
| 5,450,830 | 9/1995 | Katoh | 123/481 |

*Primary Examiner*—Willis R. Wolfe
*Attorney, Agent, or Firm*—Knobbe, Martens, Olson & Bear

[57] ABSTRACT

A feedback control system for a multi-cylinder two-cycle crankcase compression internal combustion engine. The feedback control system includes a combustion condition sensor that senses the combustion conditions in only one cylinder. Upon starting, the supply of lubricant and fuel to this one cylinder are discontinued to avoid contamination of the combustion condition sensor.

24 Claims, 6 Drawing Sheets

MULTI-CYLINDER ENGINE CONTROL SYSTEM

BACKGROUND OF THE INVENTION

This invention relates to a multi-cylinder engine control system, and more particularly to an improved feedback control system for a multi-cylinder engine.

In the interest of providing good fuel economy and effective exhaust emission control, resort has been made to feedback control systems for controlling the air/fuel ratio. By employing an exhaust sensor or a combustion product sensor, it is possible to determine if the mixture is rich or lean. Thus, by using the output of this sensor, the fuel supply can be controlled so as to maintain the desired air/fuel ratio.

One difficulty with this type of system is that the sensors employed are somewhat fragile and are prone to contamination. This problem is particularly acute in conjunction with two-cycle engines. With a two-cycle engine it is desirable to sample the combustion products almost directly in the cylinder so as to avoid dilution during the scavenging cycle. However, the two-cycle engines normally employ separate lubricating systems, and the sensor may be subjected not only to fuel contamination, but also contamination by the lubricant.

The problem is particularly acute during the original start-up mode. As is well known, it is the normal practice to run an overly rich mixture to assist in starting, particularly with a cold engine. When this is done, however, then the sensor may be contaminated and the eventual following feedback control may be erratic or inaccurate.

It is, therefore, a principal object of this invention to provide an improved feedback control system for an engine.

It is another object of this invention to provide an improved feedback control system for a multi-cylinder engine.

It is a yet further object of this invention to provide a feedback control system for a multi-cylinder engine wherein the sensor is protected during starting from contamination by either fuel and/or lubricant.

SUMMARY OF THE INVENTION

This invention is adapted to be embodied in a control system and method for a multi-cylinder internal combustion engine having a plurality of individual combustion chambers. Means are provided for delivering a air-fuel charge to the combustion chambers for combustion therein. An exhaust system collects the exhaust gases from the combustion chambers and discharges them to the atmosphere. A combustion condition sensor is provided for sensing the combustion products in only one of the combustion chambers. The output of that combustion condition sensor is employed for controlling the air/fuel ratio supplied to the engine by the charge forming and induction system. Means are provided for starting the engine.

In accordance with an engine constructed in accordance with this invention, the charge forming means discontinues the supply of fuel to the one combustion chamber during operation of the starting means so as to protect the combustion condition sensor during this operation.

In accordance with a method for practicing the invention, the supply of fuel by the charge forming means to the one combustion chamber is discontinued when the starting means is operated for preventing contamination of the combustion condition sensor.

In accordance with an engine and method for performing further features of the invention, the engine is further provided with a lubricating system for supplying lubricant to the components which define each of the combustion chambers.

In accordance with an engine embodying this feature of the invention, the supply of lubricant to the components of the one combustion chamber is discontinued in response to operation of the starting means.

In accordance with a method for performing this feature of the invention, the supply of lubricant to the components that define the one combustion chamber is discontinued in response to the starting of the engine.

DETAILED DESCRIPTION OF THE PREFERRED EMBODIMENT OF THE INVENTION

Figure 1:
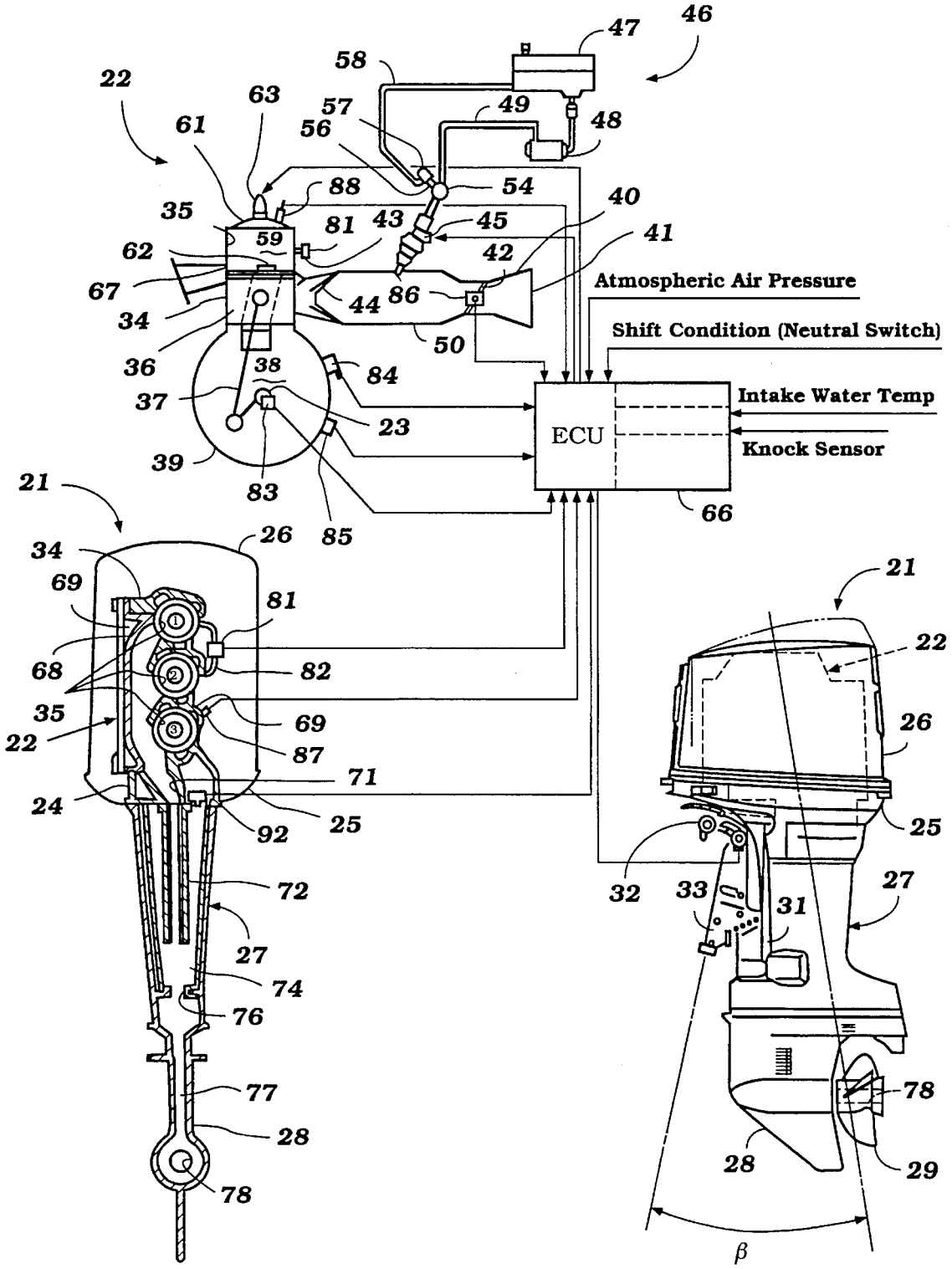
FIG. 1 is a three-part view showing an outboard motor constructed in accordance with an embodiment of the invention and side elevational view in the lower right-hand side, a cross-sectional view taken along a generally vertically extending plane on the lower left-hand side view and a schematic horizontal cross-sectional view through one cylinder of the engine and showing the control system and control elements partially in schematic form.
Figure 2:
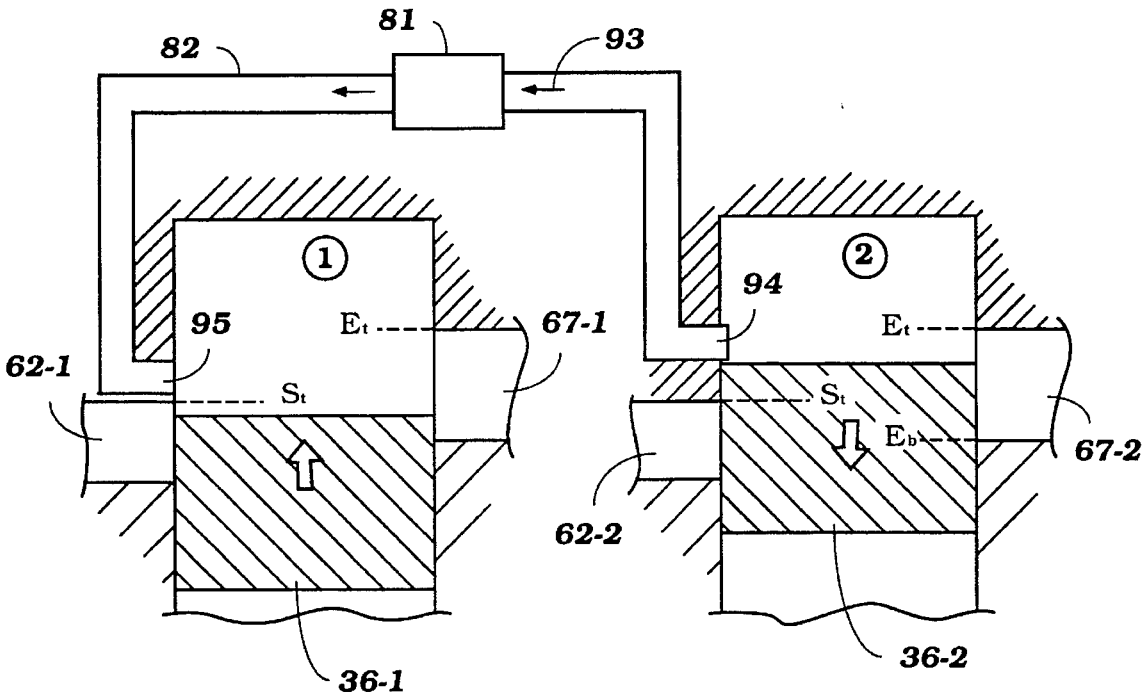
FIG. 2 is an enlarged schematic cross-sectional view taken through two cylinders of the engine and showing the connection of the exhaust sensor thereto.

Referring now in detail to the drawings, and initially to FIG. 1, an outboard motor is shown in the lower portion of this figure in rear cross section and side elevation and is indicated generally by the reference numeral 21. The invention is shown in conjunction with an outboard motor because the invention has particular utility in conjunction with two-cycle crankcase compression engines. Such engines are normally used as the propulsion device for outboard motors. For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The engine 22 is shown in the lower view of FIG. 1, with a portion broken away, and in a schematic cross-sectional view through a single cylinder in the upper view of this figure. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the aforenoted drive shaft housing which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft.

A steering shaft (not shown) is affixed to the drive shaft housing 27. This steering shaft is journaled for steering movement within a swivel bracket 31 for steering of the outboard motor 21 and the associated watercraft (not shown) in a well-known manner. The swivel bracket 31 is, in turn, pivotally connected by a pivot pin 32 to a clamping bracket 33. The clamping bracket 33 is adapted to be detachably affixed to the transom of the associated watercraft. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of a three-cylinder in-line configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines.

The engine 22 includes a cylinder block 34 in which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 40 which draws atmospheric air through an inlet 41 from within the protective cowling. This air is admitted to the protective cowling in any suitable manner.

A throttle body assembly 42 is positioned in an intake manifold 50 downstream of the air inlet 41 and is operated in any known manner. Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiment, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft propelled by the outboard motor 21. Fuel is pumped from the fuel tank 47 by means of a fuel pump 48, which may be electrically or otherwise operated. This fuel then passes through a fuel filter, which preferably is mounted within the power head of the outboard motor 21. Fuel flows from the fuel filter through a conduit 49 to a high-pressure fuel pump which is driven in any known manner as by an electric motor or directly from the engine 22. This fuel pump delivers fuel under high pressure to a fuel rail 59 through a conduit. The fuel rail 54 serves each of the injectors 45 associated with the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel supply system through a return line 58 for example back to the fuel tank 47.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a cylinder head assembly 61 that is affixed to the cylinder block 34 in any known manner. The charge so formed is transferred to the combustion chamber 59 from the crankcase chambers 38 through one or more scavenge passages 62.

Spark plugs 63 are mounted in the cylinder head 61 and have their spark gaps extending into the combustion chambers 59. The spark plugs 63 are fired by a capacitor discharge ignition system (not shown). This outputs a signal to a spark coil which may be mounted on each spark plug 63 for firing the spark plug 63 in a known manner.

The capacitor discharge ignition circuit is operated, along with certain other engine controls by an engine management ECU, shown schematically and identified generally by the reference numeral 66.

When the spark plugs 63 fire, the charge in the combustion chambers 59 will ignite and expand so as to drive the pistons 36 downwardly. The combustion products are then discharged through exhaust ports 67 formed in the cylinder block 34. These exhaust gases then flow through an exhaust manifold identified by the reference numeral 68. The exhaust gases then pass downwardly through an opening in the guide plate 24 to an appropriate exhaust system (in the drive shaft housing 27) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 69 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing.

Figure 5:
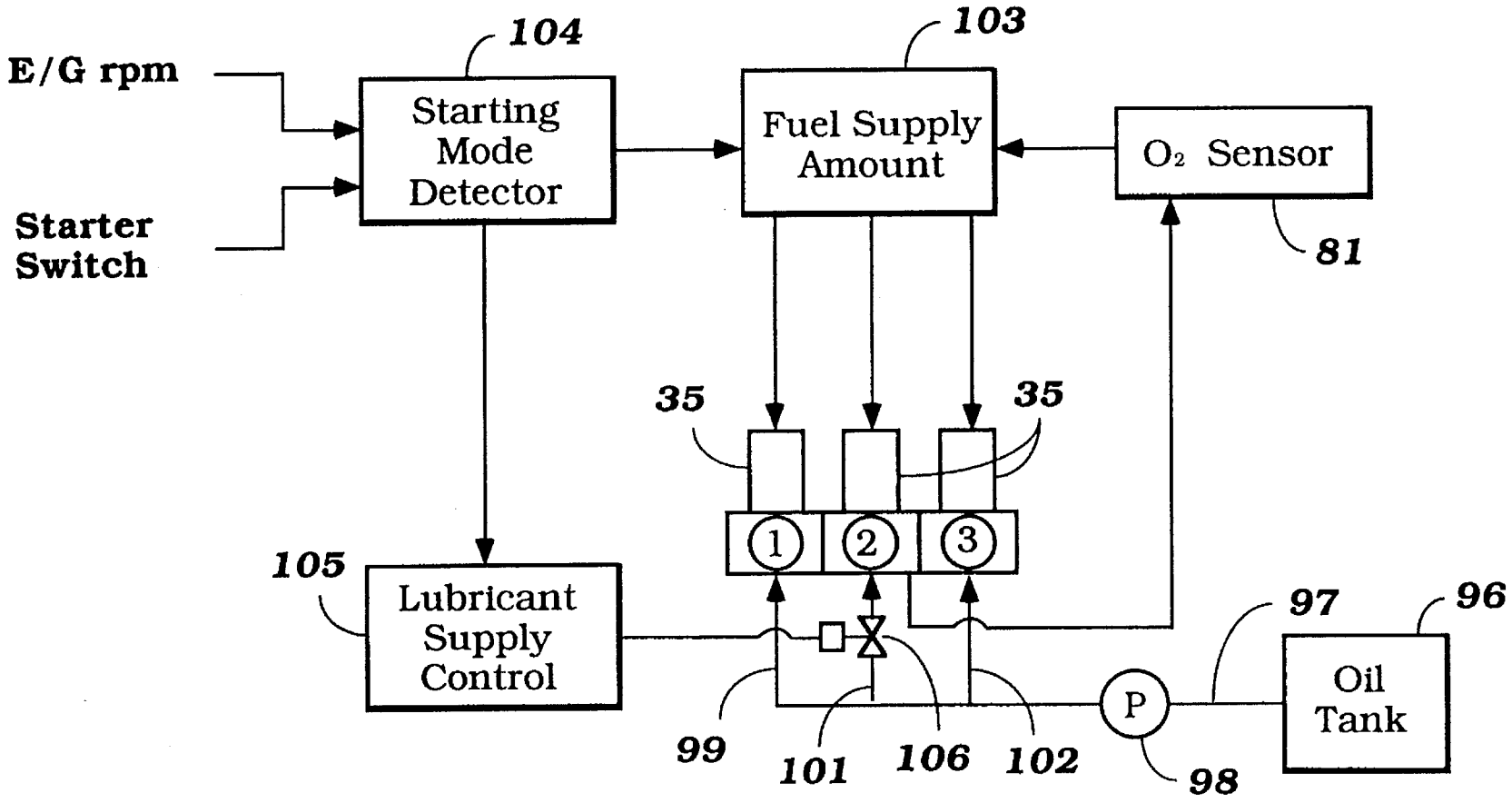
FIG. 5 is a schematic view showing the components of the engine, the charge forming system, the lubricating system, and the feedback control therefor.

Although not shown in FIG. 1, the engine 22 is also provided with a lubricating system shown schematically in FIG. 5 for lubricating the various moving components of the engine 22. This system may spray lubrication into the intake passages in proximity to the fuel injector nozzles 45 and/or may deliver lubricant directly to the sliding surfaces of the engine 22. This lubricant is supplied from a suitably positioned tank. The system will be described in more detail later.

The exhaust system for discharging the exhaust gases to the atmosphere will be described. As has been noted, the exhaust manifold 68 communicates with an exhaust passage, indicated by the reference numeral 71, that is formed in the spacer or guide plate 24. An exhaust pipe 72 is affixed to the lower end of the guide plate 24 and receives the exhaust gases from the passage 71.

The exhaust pipe 72 depends into an expansion chamber 74 formed within the outer shell of the drive shaft housing 27. This expansion chamber 74 is defined by an inner member which has a lower discharge opening 76 that communicates with an exhaust chamber 77 formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft is operating when traveling at high speeds. In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft is traveling at a low rate of speed or is idling, and the through-the-hub exhaust gas discharge 78 will be deeply submerged.

It has been noted that the ECU 66 controls the capacitor discharge ignition circuit and the firing of the spark plugs 63. In addition, the ECU controls the fuel injectors 45 so as to control both the beginning and duration of fuel injection and the regulated fuel pressure, as already noted. The ECU 66 may operate on any known strategy for the spark control and fuel injection control 45, although this system employs an exhaust sensor assembly indicated generally by the reference numeral 81 constructed in accordance with any of the embodiments of the copending application of Masahiko Katoh, Ser. No. 08/435,715 (attorney docket no. SANSH2.941A), filed May 5, 1995, the disclosure of which is incorporated herein by reference still pending. Specifically, the embodiment illustrated here embodies the same sensor construction as shown in FIGS. 1–10 of that copending application. Since the invention in this application deals primarily with the control system rather than the construction of the sensor, the sensor per se will not be described in detail. However, the principal of operation of the sensor will be described later when the mode of operation of the preferred embodiments of this invention are described.

The sensor 81 is positioned in a conduit 82 that is interconnected between two of the cylinders (cylinders 1 and 2 in the illustrated embodiment) for a reason which will also be described later.

So as to permit engine management, a number of additional sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown schematically in FIG. 1 include a crankshaft position sensor 83 which senses the angular position of the crankshaft 23 and also the speed of its rotation. A crankcase pressure sensor 84 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 85 may be provided in the crankcase chamber 38 for sensing the temperature of the intake air. In addition, the position of the throttle valve 42 is sensed by a throttle position sensor 86. Engine temperature is sensed by a coolant temperature sensor 87 that is mounted in an appropriate area in the engine cooling jacket 69. An in-cylinder pressure sensor 88 may be mounted in the cylinder head 61 so as to sense the pressure in the combustion chamber 59.

Other sensors which are not shown but their outposts to the ECU are noted in FIG. 1 include a knock sensor may also be mounted in the cylinder block 34 for sensing the existence of a knocking condition. Certain ambient conditions also may be sensed, such as atmospheric air pressure, intake cooling water temperature, this temperature being the temperature of the water that is drawn into the cooling system before it has entered the engine cooling jacket 69.

In accordance with some portions of the control strategy, it may also be desirable to be able to sense the condition of the transmission for driving the propeller 29 or at least when it is shifted into or out of neutral. Thus, a transmission condition sensor is mounted in the power head and cooperates with the shift control mechanism for providing the appropriate indication as indicated schematically.

Furthermore, a trim angle sensor 91 is provided for sensing the angular position of the swivel bracket 31 relative to the clamping bracket 33 and the trim angle $\beta$ of the outboard motor 21.

Finally, the engine exhaust gas back pressure is sensed by a back pressure sensor that is positioned within the expansion chamber 74 which forms part of the exhaust system for the engine and which is positioned in the drive shaft housing 27. B The way in which the exhaust sensor 81 operates so as to sample the combustion products from one of the cylinders at the end of the combustion cycle without being diluted with incoming charge is described in more detail in the aforenoted copending application but the theory will be described by particular reference to FIGS. 2 and 3 since they indicate how the system provides good sampling and undiluted sampling so that the exhaust sensor 81, which as has been noted is an $O_2$ sensor, can provide good feedback control.

Basically, the theory of operation is that the conduit 82 that supplies the sample of combustion products to the sensor 81 is interconnected between two cylinders that are out of phase with each other. In the illustrated embodiment, these are the cylinders 1 and 2 numbering the cylinders from the top and wherein cylinder 2 is the active cylinder from which the combustion products are sampled. Cylinder 1 acts, in effect, as a valve to control the direction of flow so that it is generally in the direction of the arrows 93 shown in FIG. 2 so that the combustion products from cylinder 2 are sampled and also they are sampled at a point at the end of the combustion cycle.

Basically, the conduit 82 has a port opening 94 into cylinder 2 at a point that is approximately equal to the point when the exhaust port 67-2 is open ($E_t$). This is at a time when the combustion in cylinder 2 is substantially completed and the exhaust port will open so that the exhaust gases can flow out of the exhaust port 67-2. As may be seen in FIG. 3, which is a pressure trace of the cylinder pressures with the cylinder 2 pressure being indicated at P2 and the pressure in cylinder 1 being indicated at P1. It will be seen that when the piston 36-2 sweeps across the port 94 the pressure in the combustion chamber of cylinder 2 will have been falling because the gases have been burning and expanding. At the point in time when the exhaust port opens the pressure will continue to be dropping but it will still be greater than the atmospheric pressure indicated at the value 1 in FIG. 3.

The conduit 82 also has a port opening 95 which communicates with cylinder 1 but this port opening is disposed to be immediately adjacent the point when the scavenge port 62-1 of cylinder 1 is closed by the upward movement of the piston 36-1. Hence, there will be a positive flow from the cylinder 2 to the cylinder 1 through the sensor 81 and conduit 82 at this time period. At this point in time, cylinder 1 will have its pressure generally at atmospheric pressure because the charge which has been compressed in the crankcase chamber and is transferred to the combustion chamber will not have undergone any further pressure in the cylinder 1. Hence, the flow is in the direction of the arrow 93.

As may be seen, when the piston 36-2 continues to move downwardly eventually the scavenge port 62-2 will open and then the diluting charge will enter the combustion chamber of cylinder 2. However, by this time the port 95 in cylinder 1 will have been closed and hence no flow can occur through the conduit 82 and the sensor 81 will only receive final combustion products from cylinder 2 at the end of the cycle.

Figure 3:
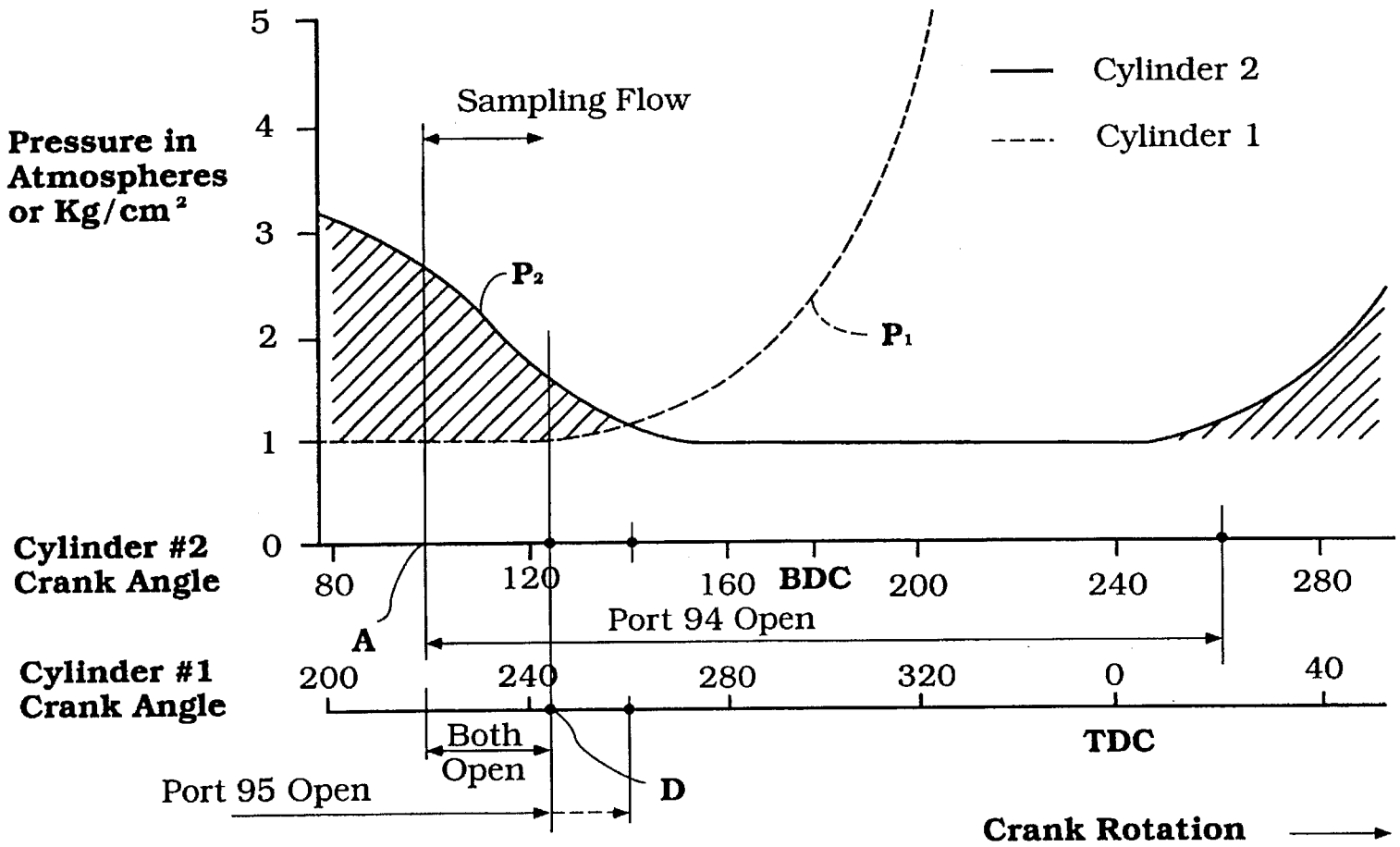
FIG. 3 is a graphical view showing the relationship of the pressure in the various cylinders and to illustrate how the exhaust sampling is controlled.

The sampling time is as indicated on the timing diagram of FIG. 3 and this being basically the time when both ports 94 and 95 are open. In fact, when port 95 is closed and port 94 is still open, the pressure in the conduit 82 will be higher than the pressure in the cylinder 2 and hence there will actually be some purging of the accumulator chamber containing the sensor 81 back into the cylinder 2 so that the sensor 81 always receives a fresh charge of combustion products for each cycle.

Because the port opening 94 of the conduit 82 in cylinder 2 is higher in the cylinder bore than the port opening 95 in cylinder 1, port opening 94 will be open for a longer period of time than will the opening of port 95. These respective timings are indicated in the distance between the points A and D in FIG. 3 and this is the time when the actual sampling will occur.

Figure 4:
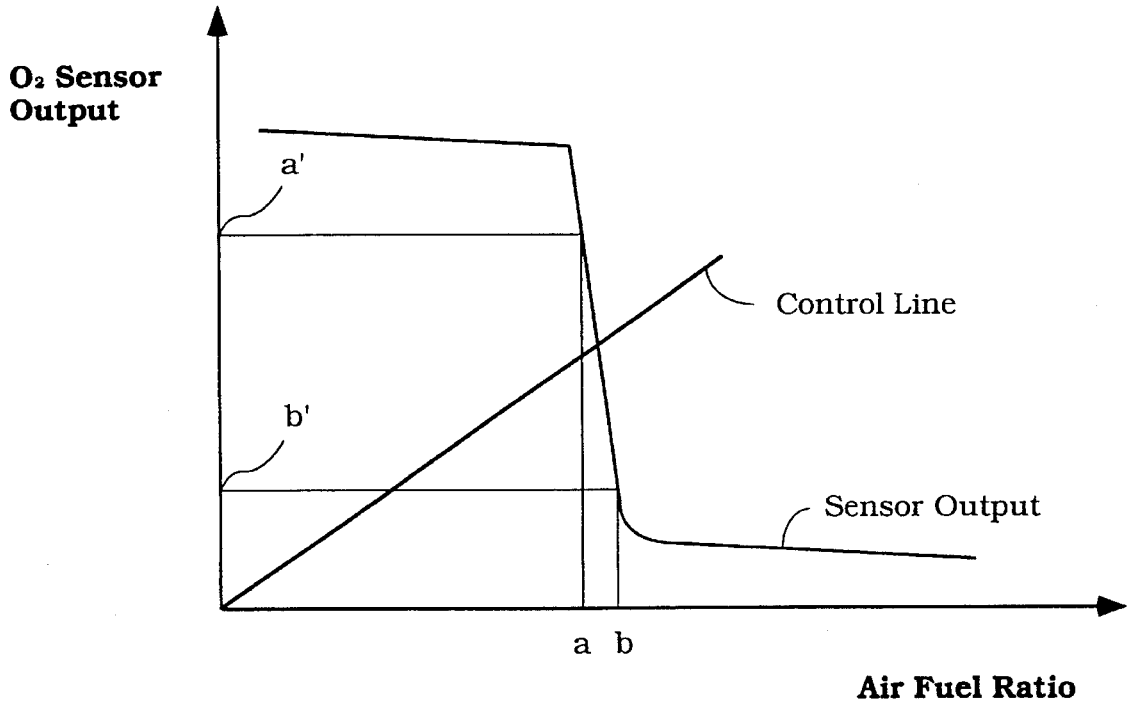
FIG. 4 is a graphical view showing the output of an oxygen sensor in relation to air/fuel ratio and the control range applied.

As is well known, sensors like the oxygen sensor 81, although they are very useful in providing an indication of mixture strength for feedback control, are basically on/off devices. FIG. 4 shows the sensor output curve and how the sensor output varies significantly in a very small range relative to the actual change in air/fuel ratio. Therefore, it is desirable to operate on the control line indicated in this figure in the range a–b/a'b' so as to provide the control.

Because of this criticality of the output of the oxygen sensor 81, it is very important to protect the oxygen sensor from contamination. Thus, the control routine and engine and its accessories are operated in such a way as to protect the sensor 81 from contamination, primarily during starting, in a manner which will be described. Except for the starting mode, the control strategy may be the same as set forth in the aforenoted copending application. Alternatively, various other types of feedback control may be employed for controlling the air/fuel ratio during normal running conditions.

Referring first to FIG. 3, this shows the associated components for the engine dealing with the normal running operation and also for controlling the start-up operation. It should be noted that the engine 22 is provided with an electric starter, which may be of any known type and which cooperates with a starter gear on the flywheel which is attached to the crankshaft 23 for starting the engine in a known manner. An appropriate starter switch is provided for activating the starter.

The lubricant supply system, previously referred to, is also illustrated schematically in FIG. 5, and this includes an oil tank, indicated generally by the reference numeral 96, which may be positioned either within the power head or remotely in the associated watercraft. Oil is supplied to the engine from the oil tank 96 through a conduit 97 in which a flow controlling pump 98 is provided. The pump 98 discharges through three branch supply conduits 99, 101, and 102, which supply the individual cylinders 1, 2, and 3 either through their intake system or through direct lubrication of various components or a combination of them as aforenoted. The strategy by which the amount of lubricant supplied is controlled and the manner for controlling it forms no part of the invention, except for the starting mode which will be described.

Figure 6:
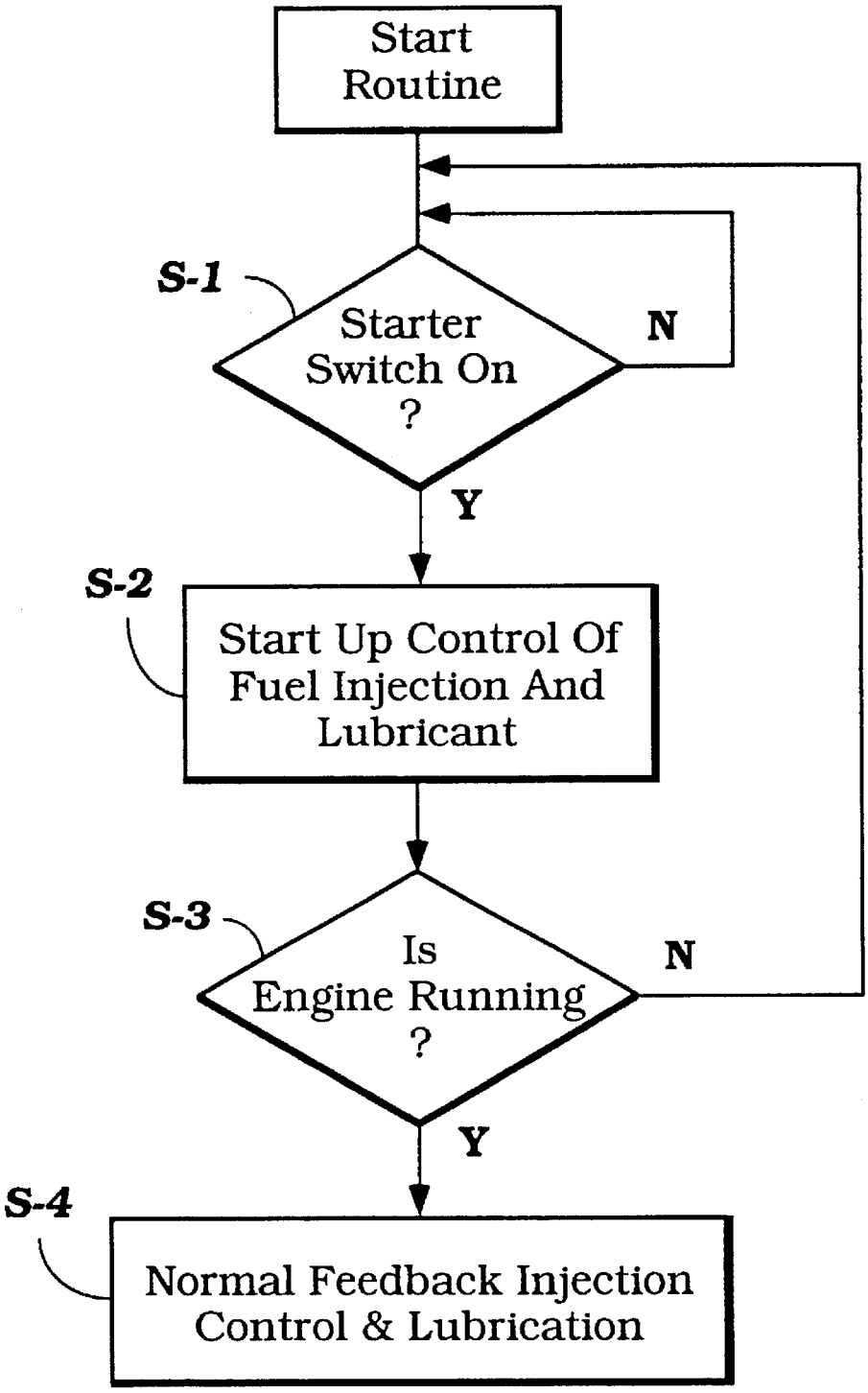
FIG. 6 is a block diagram showing the control routine during starting.

The ECU 66 has a section, indicated schematically in FIG. 3 by the reference numeral 103, which controls the amount of fuel supplied, including the feedback from the oxygen sensor 81. In addition, this fuel supply amount receives an input from a starting mode detector 104 which operates in a control routine as shown in FIG. 6 to indicate when the engine is being started. The starting operation and eventual running are sensed by inputs from a starter switch and the engine speed, which, as has been noted, can be determined from the crankshaft position sensor 83.

In addition to controlling the fuel supply amount, the starting mode detector also outputs a signal to a lubricant supply control section 105 which operates an on/off shut-off valve 106 in the branch line 101 that goes to cylinder no. 2, this being the cylinder where the combustion products are detected.

Basically, the way the system operates is that when the engine is being started, no fuel is supplied to cylinder no. 2 and no lubricant is supplied to this same cylinder. As a result, if there are any start-up difficulties, then the sensor 109 which senses the condition in cylinder no. 2 will not be fouled. Of course, if the combustion products in a different cylinder are sensed by a sensor in that cylinder, then this is the cylinder which will be controlled on starting.

Referring now to the control mode shown in FIG. 6, the control routine begins at the step S1 where the condition of the starter switch is read by the starting mode detector 104 of the ECU 66. If the starter switch is not on, the program repeats.

If, however, the starter switch is turned on at the step S1, then the program moves to the step S2 so as to initiate the sensor protective strategy. This is done by outputting a signal to the fuel supply amount 103 so as to discontinue the supply of fuel from the fuel injector 45 to cylinder no. 2. At the same time, the control signal is sent to the lubricant supply control 105 to activate the control valve 106 and close it so as to shut off the supply of lubricant to cylinder no. 2.

The program then moves to the step S3 to determine whether the engine is running on its own. This can be determined by checking both the condition of the starter switch and also the actual speed at which the engine is running. If the engine is not running on its own, the program repeats back. If, however, the program is running on its own, the ECU then moves to the step S4 so as to discontinue the start-up routine and move to a normal feedback control routine.

In the described embodiment, both the fuel supply and lubricant supply to the sensed cylinder are discontinued during starting. It should be obvious to those skilled in the art that either or both of these expedients can be used, one independently of the other. Of course, the use of both features provides some obvious advantages. In addition, a variety of other changes and modifications may be made without departing from the spirit and scope of the invention, as defined by the appended claims.

We claim:

1. An internal combustion engine having a plurality of combustion chambers, a charge forming and induction system for supplying an air-fuel charge to each of said combustion chambers, an exhaust system for collecting combustion products from said combustion chambers and discharging them to the atmosphere, an exhaust condition sensor for sensing the condition of the combustion products directly in one of said combustion chambers, feedback control means receiving the signal from said combustion condition sensor and controlling said charge forming system for controlling the air/fuel ratio supplied to said engine to maintain the desired air/fuel ratio, starting means for starting said engine, means for sensing the operation of said starting means, and means for precluding the supply of fuel to said one cylinder during the operation of said starting means.

2. An internal combustion engine as set forth in claim 1, wherein the combustion condition sensor senses the combustion products directly from the combustion chamber.

3. An internal combustion engine as in claim 2, wherein the engine operates on a two-stroke crankcase compression principle and the combustion products are sensed by communicating the combustion condition sensor with the combustion chamber through a port juxtaposed to open at approximately the same time as the engine exhaust port opens.

4. An internal combustion engine as set forth in claim 3, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

5. An internal combustion engine as in claim 1, further including means for supplying lubricant to the components which define each of the combustion chambers and means for precluding the supply of lubricant to the components that define the one combustion chamber during operation of the starting means.

6. An internal combustion engine as in claim 5, wherein the combustion condition sensor senses the combustion products directly from the combustion chamber.

7. An internal combustion engine as in claim 6, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

8. An internal combustion engine as in claim 7, wherein the engine operates on a two-stroke crankcase compression principle and the combustion products are sensed by communicating the combustion condition sensor with the combustion chamber through a port juxtaposed to open at approximately the same time as the engine exhaust port opens.

9. An internal combustion engine having a plurality of combustion chambers, a charge forming and induction system for supplying an air-fuel charge to each of said combustion chambers, a combustion condition sensor for sensing the combustion conditions directly in one of said combustion chambers, an exhaust system for collecting the combustion products from said combustion chambers and delivering them to the atmosphere, feedback control means for controlling the amount of fuel supplied to said combustion chambers by said charge forming means in response to the output of said combustion condition sensor for maintaining the desired air/fuel ratio, starting means for starting said engine, lubricating means for supplying lubricant to the components which define each of said combustion chambers, and means for precluding the supply of lubricant from said lubricating means to the components defining said one combustion chamber in response to operation of said starting means.

10. An internal combustion engine as in claim 9, wherein the combustion condition sensor senses the combustion products directly from the combustion chamber.

11. An internal combustion engine as in claim 10, wherein the engine operates on a two-stroke crankcase compression principle and the combustion products are sensed by communicating the combustion condition sensor with the combustion chamber through a port juxtaposed to open at approximately the same time as the engine exhaust port opens.

12. An internal combustion engine as in claim 11, wherein the combustion product sensor is positioned in a conduit interconnecting the port with a port in another combustion chamber operating on a different cycle for maintaining a constant flow of combustion products to the combustion condition sensor on each cycle of operation of the first-mentioned combustion chamber.

13. A method of operating an internal combustion engine having a plurality of combustion chambers, a charge forming and fuel injection system for supplying an air-fuel charge to each of said combustion chambers, an exhaust system for collecting combustion products from said combustion chambers and discharging them to the atmosphere, and starting means for starting said engine, said method comprising the steps of sensing the condition of the combustion products in one of said combustion chambers, controlling said charge forming system for controlling the air/fuel ratio supplied to said engine to maintain the desired air/fuel ratio, sensing the operation of said starting means, and precluding the supply of fuel to said one cylinder during the operation of said starting means.

14. A method as in claim 13, wherein the combustion products are sensed directly from the combustion chamber.

15. A method as in claim 14, wherein the engine operates on a two-stroke crankcase compression principle and the combustion products are sensed by communicating a combustion condition sensor with the combustion chamber through a port juxtaposed to open at approximately the same time as the engine exhaust port opens.

16. A method as set forth in claim 15, wherein the combustion chamber sensor is positioned in a conduit interconnecting the aforenoted port with a port in another combustion chamber operating on a different cycle for maintaining a constant flow of fresh combustion products to the combustion condition sensor on each cycle of operation of the first-mentioned combustion chamber.

17. A method as in claim 13, further including supplying lubricant to the components which define each of the combustion chambers and precluding the supply of lubricant to the components that define the one combustion chamber during operation of the starting means.

18. A method as in claim 17, wherein the combustion products are sensed directly from the combustion chamber.

19. A method as in claim 18, wherein the engine operates on a two-stroke crankcase compression principle and the combustion products are sensed by communicating a combustion condition sensor with the combustion chamber through a port juxtaposed to open at approximately the same time as the engine exhaust port opens.

20. A method as set forth in claim 19, wherein the combustion chamber sensor is positioned in a conduit interconnecting the aforenoted port with a port in another combustion chamber operating on a different cycle for maintaining a constant flow of fresh combustion products to the combustion condition sensor on each cycle of operation of the first-mentioned combustion chamber.

21. A method of operating an internal combustion engine having a plurality of combustion chambers, a charge forming and induction system for supplying an air-fuel charge to each of said combustion chambers, starting means for starting said engine, lubricating means for supplying lubricant to the components which define each of said combustion chambers, an exhaust system for collecting the combustion products from said combustion chambers and delivering them to the atmosphere, a combustion condition sensor for sensing the combustion conditions directly in one of said combustion chambers, said method comprising the steps of controlling the amount of fuel supplied to said combustion chambers by said charge forming means in response to the combustion condition for maintaining the desired air/fuel ratio, and precluding the supply of lubricant from said lubricating means to the components defining said one combustion chamber in response to operation of said starting means.

22. A method as in claim 21, wherein the engine operates on a two-stroke crankcase compression principle and the combustion products are sensed by communicating a combustion condition sensor with the combustion chamber through a port juxtaposed to open at approximately the same time as the engine exhaust port opens.

23. A method as set forth in claim 22, wherein the combustion chamber sensor is positioned in a conduit interconnecting the aforenoted port with a port in another combustion chamber operating on a different cycle for maintaining a constant flow of fresh combustion products to the combustion condition sensor on each cycle of operation of the first-mentioned combustion chamber.

24. A method as in claim 23, further including supplying lubricant to the components which define each of the combustion chambers and precluding the supply of lubricant to the components that define the one combustion chamber during operation of the starting means.

* * * * *